US011660616B2

(12) United States Patent
Hundertmark et al.

(10) Patent No.: US 11,660,616 B2
(45) Date of Patent: May 30, 2023

(54) SEPARATOR HAVING STACKABLE INTERMEDIATE MEMBERS

(71) Applicant: GEA MECHANICAL EQUIPMENT GMBH, Oelde (DE)

(72) Inventors: Tim Hundertmark, Gütersloh (DE); Johannes Droste, Rosendahl (DE); Jürgen Mackel, Oelde (DE); Eduard Brak, Oelde (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 730 days.

(21) Appl. No.: 16/625,108

(22) PCT Filed: Jun. 28, 2018

(86) PCT No.: PCT/EP2018/067347
§ 371 (c)(1),
(2) Date: Dec. 20, 2019

(87) PCT Pub. No.: WO2019/002429
PCT Pub. Date: Jan. 3, 2019

(65) Prior Publication Data

US 2020/0156085 A1 May 21, 2020

(30) Foreign Application Priority Data

Jun. 30, 2017 (DE) ..... 10 2017 114 649.0

(51) Int. Cl.
*B04B 11/08* (2006.01)
*B04B 9/12* (2006.01)
(Continued)

(52) U.S. Cl.
CPC ..... *B04B 11/082* (2013.01); *B04B 9/12* (2013.01); *B04B 1/08* (2013.01); *B04B 7/02* (2013.01);
(Continued)

(58) Field of Classification Search
CPC ..... B04B 11/082; B04B 9/12; B04B 1/08; B04B 7/02; B04B 9/04; B04B 11/02; B04B 2001/2083; B04B 2005/125
(Continued)

(56) References Cited

U.S. PATENT DOCUMENTS 2,124,866 A 7/1938 Young
6,267,204 B1 7/2001 Kristensen et al.
(Continued)

FOREIGN PATENT DOCUMENTS

DE 941267 C 4/1956
DE 1057979 B 5/1959
(Continued)

OTHER PUBLICATIONS

Office Action dated Dec. 20, 2021 in related/corresponding JP Application No. 2019-572477.
(Continued)

*Primary Examiner* — Shuyi S. Liu
(74) *Attorney, Agent, or Firm* — Patent Portfolio Builders PLLC

(57) ABSTRACT

A separator includes a preassembled drive and rotation system unit having an outer ring flange portion and a drive frame having an inner ring flange. The outer ring flange portion of the preassembled drive and rotation system unit is vertically connected to the inner ring flange of the drive frame. A rotatable drum is placed onto the preassembled drive and rotation system unit, in the drum at least one paring disk is arranged in a paring chamber, and one or more stacks each having one or more stackable intermediate elements are arranged between the inner ring flange and the outer ring flange portion in order to set an axial relative position at least between the drive frame and the drive and rotation system unit.

19 Claims, 1 Drawing Sheet

(51) Int. Cl.

| | |
|---|---|
| *B04B 1/08* | (2006.01) |
| *B04B 7/02* | (2006.01) |
| *B04B 9/04* | (2006.01) |
| *B04B 11/02* | (2006.01) |
| *B04B 1/20* | (2006.01) |
| *B04B 5/12* | (2006.01) |

(52) U.S. Cl.
CPC ..... *B04B 9/04* (2013.01); *B04B 11/02* (2013.01); *B04B 2001/2083* (2013.01); *B04B 2005/125* (2013.01)

(58) Field of Classification Search
USPC ..... 494/43, 84
See application file for complete search history.

(56) References Cited

U.S. PATENT DOCUMENTS

| | | | |
|---|---|---|---|
| 7,300,396 | B2 | 11/2007 | Pitkämäki et al. |
| 7,850,590 | B2 | 12/2010 | Mackel et al. |
| 8,092,362 | B2 | 1/2012 | Kohlstette et al. |
| 9,981,275 | B2 | 5/2018 | Mackel et al. |
| 10,105,717 | B2 | 10/2018 | Mackel et al. |
| 2015/0051059 | A1 | 2/2015 | Mackel et al. |
| 2015/0266034 | A1 | 9/2015 | Klintenstedt |
| 2017/0028671 | A1 | 2/2017 | Martin |

FOREIGN PATENT DOCUMENTS

| | | | |
|---|---|---|---|
| DE | 4314440 | C1 | 6/1994 |
| DE | 102006011895 | A1 | 9/2007 |
| DE | 102006020467 | A1 | 10/2007 |
| DE | 202014003326 | U1 | 8/2015 |
| EP | 1617952 | B2 | 12/2012 |
| FR | 1287551 | A | 3/1962 |
| GB | 368247 | A | 3/1932 |
| GB | 675648 | A | 7/1952 |
| GB | 2277700 | B | 8/1997 |
| JP | S5843159 | U | 3/1983 |
| JP | 2002504212 | A | 2/2002 |
| JP | 2006522679 | A | 10/2006 |
| JP | 2016505352 | A | 2/2016 |
| WO | 2004089550 | A1 | 10/2004 |
| WO | 2013143985 | A2 | 10/2013 |
| WO | 2014072318 | A2 | 5/2014 |

OTHER PUBLICATIONS

International Search Report dated Sep. 12, 2018 in related/corresponding International Application No. PCT/EP2018/067347.
Peel Plate GMBH, "Passelemente und Justiersysteme der peel-plate GmbH," retrieved on Mar. 19, 2018, https://peel-plate.com/produkte/.
Peel Plate GMBH, "Toleranzausgleich mit Unterlgblechen und Passelementen," retrieved on Mar. 19, 2018, https://peel-plate.com/technische-details/anwendungsbereiche/toleranzausgleich/.
Search Report created on Mar. 13, 2018 in related/corresponding DE Application No. 10 2017 114 649.0.
Written Opinion dated Sep. 12, 2018 in related/corresponding International Application No. PCT/EP2018/067347.

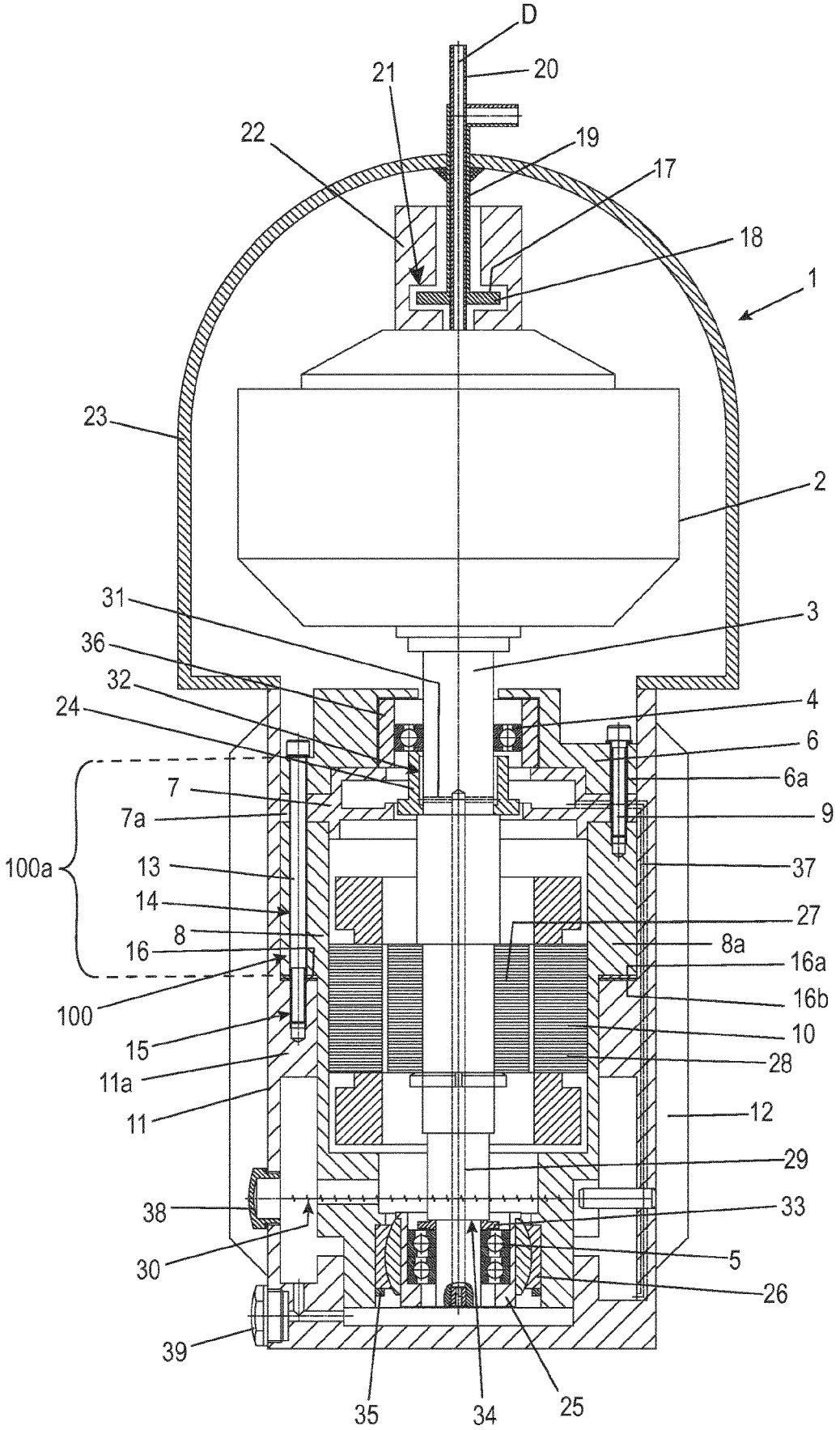
D
20
21
22
19
17
18
1
23
2
31
3
36
32
4
24
6
6a
7
7a
9
100a
13
37
14
27
8
8a
16
16a
100
16b
15
10
11a
28
11
12
29
38
33
30
5
26
39
35
34
25

SEPARATOR HAVING STACKABLE INTERMEDIATE MEMBERS

BACKGROUND AND SUMMARY OF THE INVENTION

Exemplary embodiments of the invention relate to a separator having a preassembled drive and rotation system unit with an outer annular flange portion, a drive frame with an inner annular flange, the outer annular flange portion of the preassembled drive and rotation system unit is vertically connected to the inner annular flange of the drive frame, a rotatable drum placed on the preassembled drive and rotation system unit, and at least one paring disk arranged in the drum in a paring chamber that is connected rigidly and axially to the drive frame, and a method for the assembly thereof.

Separators of this kind which are also suitable for industrial use and can preferably be used in continuous operation are known per se from the prior art.

Power transmission from the electric motor to the rotor frequently takes place via a drive belt or by means of a helical gear. Moreover, the systems known in the art also include designs in which the drum, the drive spindle, and the electric drive motor are rigidly connected to a structural unit, which is then flexibly supported as a whole on a machine frame. Examples of this kind of prior art are disclosed by the generic GB 368 247, FR 1.287.551, DE 1 057 979 and DE 43 14 440 C1.

WO 2004/089550 discloses a drum, drive spindle, and electric drive motor also rigidly connected to a structural unit, which can then be supported as a whole on a machine frame.

The overall structural design of the known structures described above is relatively complex. In addition, the cooling of the aforementioned drive devices would appear to be in need of improvement. The more modern designs in DE 10 2006 011 895 and DE 10 2006 020 467 A1 and the generic WO 2014/072318 A2 represent a development to this extent.

In generic designs, the one or more liquid phases are discharged via one or more paring disks that are stationary relative to the drum during operation and are designed as centripetal pumps. The one or more paring disks do not rotate with the drum during operation. They are, however, arranged in paring chambers of the system that rotates during operation. For this reason, the one or more paring disks must be arranged in the paring chamber(s) that rotate(s) during operation in such a manner that a distance of this kind between the parts that rotate during operation and the parts that do not rotate during operation is always retained in such a manner that the members that rotate during operation and the members that do not rotate during operation do not touch one another.

Exemplary embodiments are directed to the problem of setting the relative axial distance between members of the system which rotates during operation and members of the system which does not rotate during operation of a separator in a simple manner.

According to an embodiment, a separator comprises: a pre-assembled drive and rotation system unit having an outer annular flange portion, a drive frame with an inner annular flange, wherein the outer annular flange portion of the preassembled drive and rotation system unit is vertically connected to the inner annular flange of the drive frame, wherein a rotatable drum is placed on the preassembled drive and rotation system unit, and wherein at least one paring disk is arranged in the drum in a paring chamber connected as a whole rigidly and axially to the drive frame, and wherein between the inner annular flange and the outer annular flange portion one or more stacks is/are arranged made up of one or more stackable intermediate members in each case for setting an axial relative position at least between the drive frame, on the one hand, and the drive and rotation system unit, on the other, and wherein or by virtue of which the axial relative position between the drum and the at least one paring disk is also adjustable using the intermediate members.

According to an advantageous development, a hood structure fastened to the drive frame and surrounding the drum can be placed on the drive frame, wherein the paring disk is fastened to the hood structure so that the paring disk is connected to the drive frame axially and rigidly in this manner.

According to another advantageous development, the drive frame with the inner annular flange is configured in the manner of an outer housing and assumes the function of a machine frame.

According to one variant, the outer annular flange portion of the preassembled drive and rotation system unit lies on the inner annular flange of the drive frame.

According to an alternative variant, the outer annular flange portion of the preassembled drive and rotation system unit may be arranged beneath the inner annular flange of the drive frame. The intermediate members are each arranged between the inner annular flange and the outer annular flange portion.

It is particularly advantageous that, by virtue of the stackable intermediate members, the vertical distance between the drive frame and preferably also the one paring disk connected axially and rigidly thereto and the drive and rotation system unit and a drum arranged thereupon can also be set or is set in a surprisingly simple manner. In this way, a setting of the relative axial distance between members of the system that rotates during operation and members of the non-rotating system of a separator is easily possible.

It is advantageous that before or after the preassembled unit has been mounted on the drive frame, the drum is placed or remains placed on this unit, that at least one paring disk is arranged in a paring chamber in the drum, and that by means of the intermediate members the axial relative position between the drum and the at least one paring disk is also adjustable and can be set to a required dimension. If there are multiple paring disks available, these are rigidly connected to one another so that their axial position relative to the paring chambers can also be jointly set.

According to an embodiment, a method for assembling a separator comprises at least the following steps:

A) providing a preassembled drive and rotation system unit having an outer annular flange portion and providing of a drive frame having an inner annular flange, B) vertically placing the outer annular flange portion of the preassembled drive and rotation system unit on the inner annular flange of the drive frame, and C) distributing one or more stackable intermediate members between the inner annular flange and the outer annular flange portion for setting the axial relative position between the paring disk and the drive and rotation system unit.

According to a preferred variant, which makes assembly particularly simply, the preassembled drive and rotation system unit advantageously comprises at least the following: a drive spindle mounted rotatably with a bearing arrangement comprising a neck bearing and a base bearing, wherein the neck bearing is mounted in a bearing housing and wherein the bearing housing is placed directly or via at least one intermediate member such as an intermediate ring on a one-part or multipart motor housing, and wherein the bearing housing, the intermediate ring where appropriate, and the motor housing each have a annular flange portion on their outer periphery, which together form the annular flange portion of the preassembled drive and rotation system unit. In addition, it may be advantageously provided that the pre-assembled drive and rotation system unit also comprises a drive motor and a lubrication system.

So that the desired axial relative position can be set easily using the intermediate members, it is advantageous according to one variant for threaded bolts to pass through the axial bores in the annular flanges and also, where appropriate, the intermediate members that are firmly screwed into or onto axial bores of the inner annular flange of the drive frame.

Consequently, it is advantageously provided according to a further particularly simple variant in design terms for the axially stackable intermediate members to be configured as rings or annular disks. In this case, the axially stackable annular disks may exhibit the same or a different axial extent. In order to set the distance, two or three annular disks with the same axial extent can be stacked one above the other, for example. If, however, an annular disk with the overall desired axial extent is present in a supplied set of members, for example annular disks, this axially thicker annular disk can also replace the two or three axially thinner annular disks.

In order to further simplify assembly, it is advantageous for the axially stackable annular disks to be configured as rings having holes, in particular slots, distributed around their circumference, which holes have threaded bolts passing through them.

The rings may be configured with a closed circumference or without a closed circumference. It may therefore be advantageously provided that the axially stackable annular disks are configured as rings arranged circumferentially on the flange portions, which have threaded bolts passing through them. Instead of rotating rings, however, ring segments can also be provided as annular disks, so, for example, three ring segments which then each comprise one or two bores, for example, and each have one or two threaded bolts passing through them, so that in their interaction they act virtually as a closed-circumference ring in any event. An outer contour of the ring segments that corresponds to the inner radius of the drive frame preferably prevents an unwanted relative movement of these ring segments.

To this extent, the axially stackable intermediate members may not have a rotating design and multiple stacks made up of intermediate members may be distributed about the circumference between the annular flanges of the drive frame and the preassembled drive and rotation system unit.

In order to provide a structurally compact and easy-to-handle separator, it is further advantageous for air cooling to be provided as the cooling system (preferably exclusively), which comprises cooling ribs on the outer circumference of the drive frame.

The design according to the invention can therefore be advantageously added to in that the preassembled drive and rotation system unit has a closed lubricating system circuit. This is contrary to the layout as a preassembled unit but is not obligatory.

According to a further structurally advantageous variant of the invention, which further simplifies the setting of the position of the paring disk in the paring chamber of the drum, the paring disk has an axially lower disk or annular portion with a conveying member and also a paring disk shaft attached axially thereto with a discharge in the paring disk shaft, and the paring disk shaft is fixed to a hood structure that is rigidly connected to the drive frame. In this case, it may be further advantageously provided that the disk portion is arranged in the paring chamber of a drum head of the drum.

Finally, it may be advantageously—but not necessarily—provided that the rotating system with the drum and the drive spindle is supported substantially axially in the drive frame via the base bearing. To this extent, however, other variants with a support on the neck bearing can also be advantageously realized.

BRIEF DESCRIPTION OF THE DRAWING FIGURE

The invention is described in greater detail below with the help of exemplary embodiments with reference to the drawing. In the drawing:

FIG. 1 shows a sectional view of a separator according to the invention depicted schematically.

DETAILED DESCRIPTION

FIG. 1 shows a separator 1 comprising a system that does not rotate or is at a standstill during operation and a system that turns or rotates relative to the stationary system during operation. In this case, the rotating system and the stationary system each have a plurality of members.

As the first substantial member, the rotating system of the separator has a drum 2 with a vertical axis of rotation D. This drum 2 is only schematically depicted in this case. It may be differently configured. It is preferably designed for continuous operation for the continuous clarification and/or separation of a flowable product into one or two liquid phases and possibly a solid phase—in particular in the industrial process. For this purpose, its interior is preferably provided with a separating plate stack made up of separating plates (which cannot be identified or are not depicted here). The preferably single or double conical drum 2 is placed on the vertical upper end of a rotatable drive spindle 3 in this case. This drive spindle 3 is mounted rotatably with a bearing arrangement having a neck bearing 4 and a base bearing 5 in this case. The neck bearing 4 in this case is mounted in a bearing housing 6—preferably supported in a radially elastic manner. For this purpose, an elastic member 36 such as an elastic ring may be arranged between the inner circumference of the bearing housing 6 and the outer circumference of the neck bearing 4. This bearing housing use 6 does not rotate and is therefore part of the system that is stationary during operation.

The bearing housing 6 is placed directly or via at least one intermediate member, such as an intermediate ring 7, on a one-part or multipart motor housing 8. The bearing housing 6, where appropriate the intermediate ring 7 and the motor housing 8, each have an annular flange portion 6*a*, 7*a* or 8*a* on their outer circumference. These annular flange portions 6*a*, 7*a*, 8*a* are each axially stacked above one another. They can be assembled or are assembled with one another using axial screws 9 into a modular-like unit. Together they form an annular flange portion 100*a* of a drive and rotation system unit 100 that can be preassembled and is also preassembled in this case.

A drive motor 10 and the base bearing 5 are preferably also configured or arranged in the one-part or multipart motor housing 8. In this way, the rotating system with the bearing housing 6, possibly the intermediate ring 7, and the one-part or multipart motor housing 8 forms the drive and rotation system unit 100 that can be preassembled, and is preassembled, in the manner of a replaceable cassette that can be assembled as a whole. This preassembled drive and rotation system unit 100 is also briefly referred to below as a preassembled unit 100. This preassembled unit 100 may also comprise the drum 2.

The motor housing 8 is inserted into a drive frame 11. This drive frame 11 is configured in the manner of an outer housing surrounding the motor housing 8. In this case it assumes the function of a machine frame. For this purpose it may be fastened to a base such as a warehouse floor, for example.

Cooling ribs 12 may be configured on the outer circumference of the drive frame 11, so that in this way waste heat from the drive system can easily radiate into the surrounding space.

The drive frame 11 has an annular flange 11*a* on its inner circumference. The preassembled drive and rotation system unit 100 is fastened to this annular flange 11*a*, so that this unit 100, in this case the annular flange 8*a* of the motor housing 8, is connected directly or indirectly in a manner yet to be described to the annular flange portion 100*a*. In this case, the outer annular flange portion 100*a* of the preassembled drive and rotation system unit 100 may lie, as depicted, on the inner annular flange 11*a* of the drive frame 11 or, in an alternative embodiment, it may be suspended thereunder.

The preassembled unit 100 and its annular flange portion 100*a* are preferably fastened, in particular tightly screwed, using at least one or more fastening means, in particular one or more threaded bolts 13, to the annular flange 11*a* of the drive frame 11.

For this purpose, the outer annular flange portion 100*a* of the preassembled unit formed in this case by the annular flange portions 6*a*, 7*a* and 8*a* of the bearing housing 6, where appropriate of the intermediate ring 7, and of the motor housing 8 (flush in each case), contains axial bores 14 that are oriented flush with further axial bores 15 or blind holes—threaded where appropriate—in the annular flange 11*a* of the drive frame 11.

It is possible in this case for one or more stackable intermediate members 16, in particular annular disks 16*a, b*, . . . , possibly each in the manner of an annular disk stack, to be arranged between the annular flange portion 8*a* and the annular flange 11*a* of the drive frame 11. Consequently, the preassembled drive and rotation system unit 100 with the bearing housing 6, where appropriate the intermediate ring 7 and the motor housing 8, and also the preferably entire rotating system are used and threaded bolts 13 are distributed that pass through the axial bores 14 of the annular flanges 6*a*, 7*a*, 8*a* and 11 and possibly the intermediate members and which are therefore tightly screwed in the axial bores 15 provided with a thread in the inner annular flange 11*a* of the drive frame 11.

With the help of the axially stackable intermediate members 16, in particular the one or more stackable annular disks 16*a, b*. c, the relative distance between the drum 2 and the drive frame 11 with the hood can be changed in the axial direction using simple means by selecting the number of intermediate members 16 in such a manner that the desired dimension is set. The annular disks 16*a, b*, . . . may exhibit the same or a different axial extent.

This is particularly advantageous since at least one paring disk 17, which does not rotate during operation and is fixed to a hood construction 23, projects into the drum 2, which rotates during operation. The relative axial position of the drum 2 and paring disk 17 must be exactly set to this extent during assembly of the separator 1. This was very time-consuming according to the prior art and is substantially simplified by the design described above. This is because adjusting this axial relative position simply requires the height of the intermediate member stack made up of intermediate members 16, in particular annular disks 16*a, b*, . . . , to be changed by none, one or more of these intermediate members 16 being arranged between the inner annular flange 11*a* of the drive frame 11 and the preassembled, in particular cassette-like, drive and rotation system unit 100.

The paring disk 17 in this case has an axially lower disk or ring portion 18 with a conveying member and also a paring disk shaft 19 attached axially thereto. The conveying member may be configured as an opening formed on the outer circumference of the disk portion 18, which opening opens out into a discharge in the paring disk shaft 19, through which a product phase being discharged can be conducted axially from the drum 2 into a downstream discharge (not depicted in detail here).

The paring disk shaft 19 coaxially surrounds a feed pipe 20. The feed pipe projects freely into the drum. Alternatively, the entrance region of the feed pipe 20 into the drum 2 may also be hermetically sealed. The disk portion 18 is formed in a paring chamber 21 of a drum head 22 of the drum 2 at the upper axial end above the drum 2. The drum head 22 of the drum 2 co-rotates with the drum during operation. It is part of the rotating system.

Conversely, the paring disk 17 with the disk portion 18 and its paring disk shaft 19 do not rotate during operation. Likewise, the feed pipe 20 does not rotate with the drum 2. There is therefore a relative rotation between the drum head 22, which delimits the paring chambers 21 outwardly, and the paring disk 17 inserted therein. It must therefore be ensured that the paring disk 17 is arranged axially roughly in the middle of the paring chamber 21, so that it cannot come into contact with the inner wall thereof during rotations of the drum 2.

This axial orientation may take place according to the invention through the arrangement of one or more intermediate members 16 between the inner annular flange 11*a* of the drive frame 11 and the annular flange portion 8*a* of the preassembled drive unit, in particular of the motor housing 8.

A hood structure 23 is placed on the drive frame. This is fastened to the drive frame 11. The hood structure 23 surrounds the drum 2.

The paring disk 17—in this case the paring disk shaft 19—is fastened to the hood structure 23 and preferably also passes through this. The paring disk 17 is connected to the drive frame 11 as a whole axially and rigidly.

In order to cool the drive, an air cooling system is used in this case, which is realized by the cooling ribs 12. This is advantageous and simple. However, liquid cooling may also be used in addition or as an alternative.

The supply of lubricant to the bearings 4, 5 may likewise take place in different ways. In this case, the drive spindle 3 has a bore 29 passing through it axially, wherein the drive spindle 3 is immersed in an oil sump 30 at the bottom in the drive frame 11. Oil is conveyed through the bore 29 in the drive spindle 3 to below the neck bearing 4 in a suction tube manner. Here it is conveyed radially through one or more transverse bores 31 and inwardly to the neck bearing 4 through an annular channel 32 in a ring or a sleeve 24, wherein the neck bearing 4 is lubricated and then runs axially downwards in a vertical channel 37. The ring 24 is supported vertically on a graduation of the drive spindle 3.

The neck bearing 4 is preferably configured as a roller bearing and is designed as a floating bearing in this case. An inspection glass 38 may be provided for this purpose, in order to allow a visual inspection of the oil level. A drain screw 39 allows the oil to be changed.

The base bearing 5 is configured as an axial fixed bearing and arranged on the drive spindle 3. In addition, it is inserted via its outer ring in a bearing housing pot 25. The bearing housing pot 25 is inserted in an inner ring of a joint bearing 26, wherein the joint bearing has spherical bearing surfaces. The joint bearing 26 also has an outer ring which is axially fixed in the motor housing 8.

The joint bearing 26 makes the drive spindle 3 universally movable or tiltable, so that the drive spindle 5 with the drum 2 is able to follow the precision movements of the drum 2 during operation.

In this case, the weight of the drum 2 with all the drive parts that are connected to the drive spindle 3 is substantially supported via the lower base bearing 5 in the motor housing 8. Accordingly, a roller bearing that is able to absorb the axial forces that occur in a suitable manner is preferably used in this case. Grooved ball bearings or angular ball bearings are suitable for this purpose, for example. Where necessary, these bearings may also be arranged in pairs when the forces to be absorbed require this.

The joint bearing 26 is responsible for the universal tiltability and support in this case.

Where small forces are to be absorbed, particularly axial forces, the unit as a whole comprising the joint bearing 26 and base bearing 5 may be replaced by a self-aligning ball bearing or a self-aligning roller bearing.

The base bearing 5 in this case lies upwardly with its inner ring adjacent to a ring 33 which, for its part, is adjacent to a shoulder 34 exhibiting the drive spindle 3. The outer ring of the base bearing 5 is supported downwardly based on the bearing housing pot 25. The outer ring of the joint bearing 26 is downwardly supported by a ring 35 which is fastened to the motor housing 8 on the inside.

This arrangement has a compact design and allows the weight of the drum 2 to be supported easily and reliably on the drive frame 8 via the base bearing 5.

The drive motor 10 is arranged in the axial region between the bearings as the drive mechanism. The drive motor preferably works according to an electrical operating principle and has a rotor 27 and a stator 28. This drive motor 10 lies completely between the neck bearing 4 and the base bearing 5. The electrical drive motor 10 may be an asynchronous motor or a synchronous motor—e.g., a reluctance motor. The rotor 27 is formed directly on the outer circumference of the drive spindle. The stator 28 is fastened to the motor housing 8 on the inside. Since the drive—except for the neck and base bearings 4, 5—runs in a low-wear manner, a large part of the customary maintenance work can be dispensed with, which lowers operating costs.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMBERS

1 Separator
2 Drum
3 Drive spindle
4 Neck bearing
5 Base bearing
6 Bearing housing
6*a* Annular flange portion
7 Intermediate ring
7*a* Annular flange portion
8 Motor housing
8*a* Annular flange portion
9 Axial screw
10 Drive motor
11 Drive frame
11*a* Annular flange
12 Cooling rib
13 Threaded bolt
14 Axial bore
15 Axial bore
16 Intermediate member
16*a, b*, . . . Annular disk
17 Paring disk
18 Disk portion
19 Paring disk shaft
20 Feed pipe
21 Paring chamber
22 Drum head
23 Hood structure
24 Ring
25 Bearing housing pot
26 Joint bearing
27 Rotor
28 Stator
29 Bore
30 Oil sump
31 Transverse bores
32 Annular channel
33 Ring
34 Shoulder
35 Ring
36 Elastic member
37 Vertical channel
38 Inspection glass
39 Drain screw
100 Drive and rotation system unit
100*a* Annular flange portion
D Axis of rotation

The invention claimed is:

1. A separator, comprising:

a preassembled drive and rotation system unit having an outer annular flange portion;

a drive frame with an inner annular flange, wherein the outer annular flange portion of the preassembled drive and rotation system unit is vertically connected to the inner annular flange of the drive frame, a rotatable drum is arranged on the preassembled drive and rotation system unit;

at least one paring disk is arranged in the rotatable drum in a paring chamber rigidly and axially connected to the drive frame;

one or more stacks comprising one or more stackable intermediate members configured to set an axial relative position at least between the drive frame and the drive and rotation system unit, wherein the one or more stacks is/are arranged between the inner annular flange and the outer annular flange portion, wherein an axial relative position between the rotatable drum and the at least one paring disk is also adjustable using the one or more stackable intermediate members.

2. The separator of claim 1, further comprising:

a hood structure fastened to the drive frame and surrounding the rotatable drum is arranged on the drive frame, wherein the at least one paring disk is fastened to the hood structure so that the at least one paring disk is axially and rigidly connected to the drive frame.

3. The separator of claim 1, wherein the drive frame with the inner annular flange is an outer housing and is a machine frame.

4. The separator of claim 1, wherein the rotatable drum is single or double conical drum arranged on an upper end of a rotatable drive spindle.

5. The separator of claim 4, wherein the preassembled drive and rotation system unit comprises:

the rotatable drive spindle, which is mounted rotatably with a bearing arrangement comprising a neck bearing and a base bearing, wherein the neck bearing is mounted in a bearing housing, wherein the bearing housing is arranged directly or via at least one intermediate ring on a one-part or multipart motor housing, wherein the bearing housing and the at least one intermediate ring each have a annular flange portion on their outer periphery which together form the outer annular flange portion of the preassembled drive and rotation system unit.

6. The separator of claim 5, wherein the preassembled drive and rotation system unit further comprises:

a drive motor; and a lubrication system.

7. The separator of claim 2, wherein the paring disk comprises:

an axially lower disk or disk portion with a conveying member; and a paring disk shaft attached axially to the axially lower disk or disk portion with a discharge in the paring disk shaft, wherein the paring disk shaft is fixed to the hood structure which is rigidly connected to the drive frame.

8. The separator of claim 7, wherein the axially lower disk portion is arranged in a paring chamber of a drum head of the rotatable drum.

9. The separator of claim 1, further comprising:

threaded bolts passing through axial bores in the annular flange portion of the preassembled drive and rotation system unit.

10. The separator of claim 9, wherein the threaded bolts pass through the one or more stackable intermediate members, which are firmly screwed into or onto axial bores of the inner annular flange of the drive frame.

11. The separator of claim 1, wherein the one or more stackable intermediate members are annular disks or annular segments.

12. The separator of claim 1, wherein the one or more stackable intermediate members have a same or a different axial extent.

13. The separator of claim 1, wherein the one or more stackable intermediate members are rings or annular segments having one or more slots having threaded bolts passing through the one or more slots.

14. The separator of claim 1, wherein the one or more stacks are multiple stacks of one or more intermediate members distributed about a circumference between the inner annular flange of the drive frame and the outer annular flange portion of the preassembled drive and rotation system unit.

15. The separator of claim 1, further comprising:

a cooling system comprising cooling ribs arranged on an outer circumference of the drive frame.

16. The separator of claim 1, wherein a separating plate stack comprising separating plates is arranged in the drum.

17. The separator of claim 1, wherein the preassembled drive and rotation system unit has a closed lubricating system circuit.

18. The separator of claim 5, wherein a rotating system with the rotatable drum and the rotatable drive spindle is supported axially in the one-part or multipart motor housing via the base bearing.

19. A method for assembling a separator, the method comprising:

providing a preassembled drive and rotation system unit having an outer annular flange portion;

providing a drive frame having an inner annular flange;

vertically placing the outer annular flange portion of the preassembled drive and rotation system unit on the inner annular flange of the drive frame; and arranging one or more stackable intermediate members between the inner annular flange and the outer annular flange portion to set an axial relative position between a paring disk arranged in a paring chamber of a rotatable drum and the drive and rotation system unit.

* * * * *